US005849472A

United States Patent [19]

Wang et al.

[11] Patent Number: 5,849,472

[45] Date of Patent: Dec. 15, 1998

[54] IMAGING ELEMENT COMPRISING AN IMPROVED ELECTRICALLY-CONDUCTIVE LAYER

[75] Inventors: Yongcai Wang; Charles C. Anderson, both of Penfield, N.Y.

[73] Assignee: Eastman Kodak Company, Rochester, N.Y.

[21] Appl. No.: 816,650

[22] Filed: Mar. 13, 1997

[51] Int. Cl.[6] ..... G03C 1/04

[52] U.S. Cl. ..... 430/531; 430/527; 430/529; 430/530; 430/537

[58] Field of Search ..... 430/527, 529, 430/530, 531, 537

[56] References Cited

U.S. PATENT DOCUMENTS

| | | | |
|---|---|---|---|
| 3,245,833 | 4/1966 | Trevoy | 428/328 |
| 4,078,935 | 3/1978 | Nakagiri et al. | 430/527 |
| 4,203,769 | 5/1980 | Guestaux | 430/631 |
| 4,237,194 | 12/1980 | Upson et al. | 428/424.2 |
| 4,275,103 | 6/1981 | Tsubusaki et al. | 428/148 |
| 4,394,441 | 7/1983 | Kawaguchi et al. | 430/524 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/527 |
| 4,571,361 | 2/1986 | Kawaguchi et al. | 428/328 |
| 4,845,369 | 7/1989 | Arakawa et al. | 250/484.1 |
| 4,916,011 | 4/1990 | Miller | 428/341 |
| 4,999,276 | 3/1991 | Kuwabara et al. | 430/264 |
| 5,045,394 | 9/1991 | Saverin et al. | 428/402 |
| 5,066,422 | 11/1991 | Felter et al. | 252/511 |
| 5,098,822 | 3/1992 | Tachibana et al. | 430/529 |
| 5,104,779 | 4/1992 | Saverin et al. | 430/529 |
| 5,116,666 | 5/1992 | Konno | 428/220 |
| 5,173,396 | 12/1992 | Nagasaki et al. | 430/529 |
| 5,252,445 | 10/1993 | Timmerman et al. | 430/529 |
| 5,284,741 | 2/1994 | Tachibana et al. | 430/529 |
| 5,340,676 | 8/1994 | Anderson et al. | 430/63 |
| 5,364,752 | 11/1994 | Timmerman et al. | 430/529 |
| 5,368,995 | 11/1994 | Christian et al. | 430/530 |
| 5,466,567 | 11/1995 | Anderson et al. | 430/530 |
| 5,472,832 | 12/1995 | Timmerman et al. | 430/529 |

FOREIGN PATENT DOCUMENTS

| | | |
|---|---|---|
| 63-060452 | 3/1988 | Japan . |
| 63-098656 | 4/1988 | Japan . |
| A2282245 | 11/1990 | Japan . |
| A2282248 | 11/1990 | Japan . |
| A4055492 | 2/1992 | Japan . |

*Primary Examiner*—Hoa Van Le
*Attorney, Agent, or Firm*—Carl F. Ruoff

[57] ABSTRACT

The present invention is an imaging element which includes a support, an image forming layer, and an electrically-conductive layer. The electrically conductive layer includes electronically-conductive fine particles from about 5 to 50 volume percent of said electrically-conductive layer, film-forming hydrophilic colloid, and carboxylic acid-containing polymer particles having an acid number of at least 90.

16 Claims, No Drawings

IMAGING ELEMENT COMPRISING AN IMPROVED ELECTRICALLY-CONDUCTIVE LAYER

FIELD OF THE INVENTION

This invention relates to imaging elements comprising a support material, an image-forming layer, and an electrically-conductive layer. More specifically this invention relates to electrically-conductive layers applied from a coating composition containing electronically-conductive fine particles, film-forming hydrophilic colloid, and carboxylic acid-containing polymer particles. The invention provides conductive coatings requiring reduced volume percent of the conductive fine particles. The invention is related to U.S. Pat. No. 5,340,676, ('676 patent) and provides a further improvement to the '676 patent with respect to film processing.

BACKGROUND OF THE INVENTION

The formation and discharge of electrostatic charge during the manufacture and use of photographic films are well recognized in the photographic industry. These electrostatic charges are generated by the highly insulating polymeric film bases such as polyester and cellulose acetate during winding and unwinding operations associated with the photographic film manufacturing process and during the automated transport of photographic films in film cassette loaders, cameras, and film processing equipment during use of the photographic film product.

Electrostatic charges can be effectively controlled or eliminated by incorporating one or more electrically-conductive antistatic layers in the photographic film. A wide variety of conductive materials can be incorporated into antistatic layers to provide a wide range of conductivity and antistatic performance. Typically, the antistatic layers for photographic applications employ materials which exhibit ionic conductivity where the charge is transferred by the bulk diffusion of charged species through an electrolyte. Antistatic layers comprising inorganic salts, ionic conductive polymers, and colloidal metal oxide sols stabilized by salts have been described. U.S. Pat. No. 4,542,095 discloses antistatic compositions for use in photographic elements wherein aqueous latex compositions are used as binder materials in conjunction with polymerized alkylene oxide monomers and alkali metal salts as the antistatic agents. U.S. Pat. No. 4,916,011 describes antistatic layers comprising ionically conductive styrene sulfonate interpolymers, a latex binder, and a crosslinking agent. U.S. Pat. No. 5,045,394 describes antistatic backing layers containing Al-modified colloidal silica, latex binder polymer, and organic or inorganic salts which provide good writing or printing surfaces. The conductivities of these ionic conductive antistatic layers are very dependent on humidity and film processing. At low humidity and after conventional film processing the antistatic performance is substantially reduced or ineffective.

Antistatic layers employing electronic conductors have also been described. The conductivity of these materials depends on primarily electronic mobilities rather than ionic mobilities and the conductivity is independent of humidity. Antistatic layers which contain conjugated polymers, semiconductive metal halide salts, conductive carbon or semiconductive metal oxide particles have been described. It is characteristic of these electronically conductive materials to be highly colored or have high refractive index. Thus, providing highly transparent, colorless antistatic layers containing these materials poses a considerable challenge.

U.S. Pat. No. 3,245,833 describes conductive coatings containing semiconductive silver or copper iodide dispersed as 0.1 $\mu$m or less particles in an insulating film-forming binder exhibiting surface resistivities of $10^2$ to $10^{11}$ $\Omega/\square$. However, these coatings must be overcoated with a water-impermeable barrier layer to prevent the loss of conductivity after film processing since these semiconductive salts are solubilized by conventional film processing solutions.

Conductive layers comprising inherently conductive polymers such as polyacetylene, polyaniline, polythiophene, and polypyrrole are described in U.S. Pat. No. 4,237,194, JP A2282245, and JP A2282248, but, these layers are often highly colored.

Conductive fine particles of crystalline metal oxides dispersed with a polymeric binder have been used to prepare humidity insensitive, conductive layers for various imaging applications. Many different metal oxides are alleged to be useful as antistatic agents in photographic elements or as conductive agents in electrographic elements in such patents as U.S. Pat. Nos. 4,275,103, 4,394,441, 4,416,963, 4,418,141, 4,431,764, 4,495,276, 4,571,361, 4,999,276, 5,368,995. Preferred metal oxides are antimony doped tin oxide, aluminum doped zinc oxide, niobium doped titanium oxide, and metal antimonates. The high volume percent of the conductive fine particles in the conductive coatings as taught in the prior art to achieve effective antistatic performance results in reduced transparency due to scattering losses and in brittle films subject to cracking and poor adherence to the support material.

JP A4055492 describes antistatic layers comprising conductive non-oxide particles including TiN, $NbB_2$, TiC, and MoB dispersed in a binder such as a water soluble polymer or solvent soluble resin.

U.S. Pat. No. 5,066,422 describes vinyl surface covering materials comprising a fused sheet of a dry blend, wherein the dry blend contains a polyvinyl chloride porous resin, a plasticizer, and conductive particles. Reportedly, the conductive particles reside in the pores and surface of the polyvinyl chloride resin which thereby provides surface resistivities of the fused sheet of 109 $\Omega/\square$ at low weight percent of the conductive particles.

Fibrous conductive powders comprising antimony doped tin oxide coated onto nonconductive potassium titanate whiskers have been used to prepare conductive layers for photographic and electrographic applications. Such materials have been disclosed in U.S. Pat. No. 4,845,369, U.S. Pat. No. 5,116,666, JP A63098656, and JP A63060452. Layers containing these conductive whiskers dispersed in a binder reportedly provide improved conductivity at lower volume % than the aforementioned conductive fine particles as a result of their higher aspect (length to diameter) ratio. However, the benefits obtained as a result of the reduced volume % requirements are offset by the fact that these materials are large in size (10 to 20 $\mu$m long and 0.2 –0.5 $\mu$m diameter). The large size results in increased light scattering and hazy coatings.

Transparent, binderless, electrically semiconductive metal oxide thin films formed by oxidation of thin metal films which have been vapor deposited onto film base are described in U.S. Pat. No. 4,078,935. The resistivity of such conductive thin films has been reported to be $10^5$ $\Omega/\square$. However, these metal oxide thin films are unsuitable for photographic film applications since the overall process used to prepare them is complex and expensive and adhesion of these thin films to the film base and overlying layers is poor.

U.S. Pat. No. 4,203,769 describes an antistatic layer incorporating "amorphous" vanadium pentoxide. This vanadium pentoxide antistat is highly entangled, high aspect ratio ribbons 50–100 Angstroms wide, about 10 Angstroms thick, and 0.1 to 1 $\mu$m long. As a result of this ribbon structure surface resistivities of $10^6$–$10^{11}$ Ω/□ can be obtained for coatings containing very low volume fractions of vanadium pentoxide. This results in very low optical absorption and scattering losses, thus the coatings are highly transparent and colorless. However, vanadium pentoxide is soluble at the high pH typical of film developer solutions and must be overcoated with a nonpermeable barrier layer to maintain antistatic performance after film processing.

It can be seen that a variety of methods have been reported in an attempt to obtain non-brittle, adherent, highly transparent, colorless conductive coatings with humidity independent, film process surviving antistatic performance. The aforementioned prior art references relate to some aspects of the present invention, but, they are deficient with regard to simultaneously satisfying all of the above mentioned requirements.

The '676 patent describes conductive layers comprising electrically-conductive fine particles, hydrophilic colloid, and water-insoluble polymer particles. Representative polymer particles described include polymers and interpolymers of styrene, styrene derivatives, alkyl acrylates or alkyl methacrylates and their derivatives, olefins, vinylidene chloride, acrylonitrile, acrylamide and methacrylamide derivatives, vinyl esters, vinyl ethers, or condensation polymers such as polyurethanes and polyesters. The use of a mixed binder comprising the polymer particles mentioned above in combination with a hydrophilic colloid such as gelatin provides a conductive coating that requires lower volume percent conductive fine particles compared with a layer obtained from a coating composition comprising the conductive fine particles and water soluble hydrophilic colloid alone.

Due to the high concentration of conductive particles and hydrophobic polymer particles contained in the compositions described in the '676 patent, dried layers prepared from such compositions may have reduced permeability to film processing solutions. When such layers overlie, for example, a photographic emulsion layer or dye-containing, antihalation layer, these conductive layers may have a deleterious impact on image development or dye bleaching. The carboxylic acid-containing polymer particles used in conductive layers of the present invention are readily soluble in or highly swollen by film developer solutions. This greatly improves the permeability of film processing solutions through electrically-conductive layers of the invention compared with the compositions taught in the '676 patent while still providing the benefit of reduced volume percent of conductive fine particles as described in the '676 patent.

U.S. Pat. No. 5,466,567 describes conductive layers comprising conductive fine particles, gelatin, and pre-crosslinked gelatin particles. The combination of soluble gelatin and pre-crosslinked gelatin particles as a binder for the conductive fine particles provides the benefit of reduced volume percent of conductive fine particles and good coating solution stability. The polymer particles employed as the binder in the present invention provide similar benefits to the pre-crosslinked gelatin particles described in the abovementioned patent, but, the particles in the present invention are more easily prepared and dispersed and their size and size distribution are more readily controlled.

SUMMARY OF THE INVENTION

The present invention is an imaging element which includes a support, an image forming layer, and an electrically-conductive layer. The electrically conductive layer includes electronically-conductive fine particles from about 5 to 50 volume percent of said electrically-conductive layer, film-forming hydrophilic colloid, and carboxylic acid-containing polymer particles having an acid number of at least 90.

DETAILED DESCRIPTION OF THE INVENTION

This invention relates to imaging elements comprising a support, an image-forming layer, and an electrically-conductive layer. The electrically-conductive layer may be applied as an intermediate layer or as an outer layer on either side or both sides of the support. The support may comprise any commonly used photographic support material such as polyester, cellulose acetate, or resin-coated paper.

In a particularly preferred embodiment, the imaging elements of this invention are photographic elements, such as photographic films, photographic papers or photographic glass plates, in which the image-forming layer is a radiation-sensitive silver halide emulsion layer. The photographic elements can be simple black-and-white or monochrome elements or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the photographic elements of the present invention can contain one or more auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices.

The emulsions typically will be gelatin emulsions although other hydrophilic colloids can be used in accordance with usual practice. Details regarding the silver halide emulsions are contained in *Research Disclosure*, Item 36544, September, 1994, and the references listed therein.

The photographic silver halide emulsions utilized in this invention can contain other addenda conventional in the photographic art. Useful addenda are described, for example, in *Research Disclosure*, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

Electrically-conductive layers of the invention provide conductive layers that require lower concentrations of conductive particles compared to layers that only comprise conductive particles and gelatin. At the same time, the conductive layers of the invention provide excellent permeability to film processing solutions even though they comprise low concentrations of hydrophilic colloid.

The electrically-conductive layers of the invention are applied from a coating formulation comprising electronically-conductive fine particles, film-forming hydrophilic colloid, and carboxylic acid-containing polymer particles. The conductive particle is a doped-metal oxide, a metal oxide containing oxygen deficiencies, a metal antimonate, a conductive nitride, carbide, or boride. Representative examples of these conductive fine particles include conductive $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC. Also included are conductive particles comprising electronically-conductive polymer particles such as polythiophenes, polyanilines, and polypyrroles. The conductive fine particle has an average particle size less than about 0.3 $\mu$m and a powder resistivity of $10^5$ $\Omega\cdot$cm or less.

The carboxylic acid-containing polymer particles have an acid number of at least 90 in order to insure that they are highly permeable to film developer solutions. Acid number is in general determined by titration and is defined as the number of milligrams of KOH required to neutralize 1 gram of polymer. The carboxylic acid containing polymer particles are insoluble in the coating solutions, but readily soluble in or highly swollen by film processing solutions.

The polymer particles are prepared by polymerizing one or more ethylenically unsaturated monomers containing carboxylic acid groups with other ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, β-carboxyethyl acrylate, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrenecarboxylic acid.

In addition, crosslinking comonomers can be used in the polymerization to lightly crosslink the polymer particles. It is preferable to keep the level of the crosslinking monomers low so as not to adversely affect the swelling and processing solution permeability characteristics of the particle. Preferred crosslinking comonomers are monomers which are polyfunctional with respect to the polymerization reaction, including esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctional aromatic compounds such as divinyl benzene.

The glass transition temperature ($T_g$) of the polymer particle may vary widely, but, most preferably the Tg should be at least 20° C. to provide the greatest reduction in the volume percent of conductive particle required in the electrically-conductive layers.

The polymer particles are prepared by emulsion polymerization or by post emulsification of preformed polymers. In the latter case, the preformed polymers may be first dissolved in an organic solvent and then the polymer solution is emulsified in an aqueous media in the presence of an appropriate emulsifier. The polymer particles have an average diameter of about 10 nm to 500 nm. Preferably, the particles have an average particle diameter of 20 to 200 nm.

A variety of film-forming, hydrophilic colloids may be effectively employed in the conductive layer of the present invention. Gelatin is a particularly preferred hydrophilic colloid for use in this invention. Useful gelatins include alkali-treated gelatin (cattle bone or hide gelatin), acid-treated gelatin (pigskin gelatin), and gelatin derivatives such as acetylated gelatin, phthalated gelatin, and the like. Other hydrophilic colloids that can be utilized alone or in combination with gelatin include dextran, gum arabic, zein, casein, pectin, agar-agar, albumin, and the like. Still other useful hydrophilic colloids are water-soluble polyvinyl compounds such as polyvinyl alcohol, polyacrylamide, poly(vinyl pyrrolidone), and the like.

It is an important feature of this invention that it permits the achievement of high levels of electrical conductivity with the use of relatively low volumetric fractions of the electrically-conductive fine particles. Accordingly, in the imaging elements of this invention, the electrically-conductive fine particles preferably constitute about 5 to about 50 volume percent of the electrically-conductive layer. Use of significantly less than 5 volume percent of the electrically-conductive fine particles will not provide a useful degree of electrical conductivity. On the other hand, use of significantly more than 50 volume percent of the electrically-conductive fine particles defeats the objectives of the invention in that it results in reduced transparency due to scattering losses and in brittle layers which are subject to cracking and exhibit poor adherence to the support material. It is especially preferred to utilize the electrically-conductive fine particles in an amount of from 10 to 35 volume percent of the electrically-conductive layer.

Incorporation in the electrically-conductive layer of carboxylic acid-containing polymer particles of very small size, as described herein, is of particular benefit with electrically-conductive fine particles that are more or less spherical in shape, although it is still useful with electrically-conductive fine particles that are fibrous in character.

It is important that the carboxylic acid-containing polymer particles be utilized in an effective amount in relation to the amount of hydrophilic colloid employed. Useful amounts are from about 0.3 to about 8 parts per part by weight of the film-forming hydrophilic colloid, while preferred amounts are from 0.5 to 5 parts per part by weight of the film-forming hydrophilic colloid, and particularly preferred amounts are from 0.5 to 3 parts per part by weight of the film-forming hydrophilic colloid. Use of too small an amount of the polymer particles will prevent them from performing the desired function of promoting chaining of the electrically-conductive fine particles into a conductive network, while use of too large an amount of the polymer particles will result in the formation of an electrically-conductive layer to which other layers of imaging elements may not adequately adhere.

In the electrically-conductive layer of this invention, the film-forming hydrophilic colloid forms the continuous phase and both the carboxylic acid-containing polymer particles and the electrically-conductive fine particles are dispersed therein. As hereinabove described, all three of these ingredients are essential to achieving the desired result. However, in addition to the electrically-conductive fine particles, film-forming hydrophilic colloid and carboxylic acid-containing polymer particles, the electrically-conductive layer can optionally contain wetting aids, lubricants, matte particles, biocides, dispersing aids, hardeners and antihalation dyes.

Matte particles well known in the art that may be used in the electrically-conductive layers of the invention have been described in Research Disclosure No. 308119, published Dec. 1989, pages 1008 to 1009, for example.

Typical lubricants that may be effectively employed in the electrically-conductive layers of the invention include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc. disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly(trifluorochloroethylene), poly(vinylidene fluoride, poly(trifluorochloroethylene-co-vinyl chloride), poly(meth)acrylates or poly(meth)acrylamides containing perfluoroalkyl side groups, and the like. Lubricants useful in the present invention are described in further detail in Research Disclosure No.308119, published Dec. 1989, page 1006.

The electrically-conductive layers are applied from an aqueous coating formulation that is preferably formulated to give a dry coating weight in the range of from about 100 to about 1500 mg/m$^2$. The electrically-conductive layers of this invention typically have a resistivity of less than $1\times10^{11}$ Ω/□, and preferably of less than $1\times10^{10}$ Ω/□.

The invention is illustrated by the following examples of its practice.

Preparation of carboxylic acid-containing polymer particles.

The following gives an example for the preparation a poly(methyl methacrylate-co-methacrylic acid) latex. It is understood that other polymer particle compositions can be prepared in a similar manner.

A stirred reactor containing 1012 g of deionized water and 3 g of Triton 770 surfactant (Rohm & Haas Co.) is heated to 80° C. and purged with $N_2$ for 1 hour. After addition of 1 g of potassium persulfate, an emulsion containing 2.7 g of Triton 770 surfactant, 267 g of deionized water, 240 g of methyl methacrylate, 60 g of methacrylic acid, 6 g of methyl-3-mercaptopropionate chain transfer agent, and 0.5 g of potassium persulfate is slowly added over a period of 1 hour. The reaction is allowed to continue for 4 more hours before the reactor is cooled down to room temperature. The latex prepared is filtered through an ultrafine filter (5 μm cut-off) to remove any coagulum. The polymer particle so prepared has an acid number of 130, a weight average molecular weight of about 25,000, and a particle size of about 50 nm. The latex has a pH value of 2.0–2.5.

The other carboxylic acid-containing water-insoluble polymer particle (in this case, a lightly crosslinked particle) used in the following examples is prepared in an analogous manner. The compositions of the two polymer particles prepared are described in Table 1.

TABLE 1

| Particle | Polymer Composition | Acid Number |
|---|---|---|
| P-1 | methyl methacrylate/methacrylic acid 80/20 | 130 |
| P-2 | methyl methacrylate/methacrylic acid/ethylene glycol dimethacrylate 64/35/1 | 225 |

EXAMPLES 1 AND 2 AND COMPARATIVE SAMPLES A AND B

A gelatin layer containing a developer-bleachable, yellow solid particle dye is applied onto a 4 mil thick polyethylene terephthalate film support that had been subbed with a terpolymer latex of acrylonitrile, vinylidene chloride, and acrylic acid. The dye-containing layer contained 400 mg/m$^2$ gelatin, 200 mg/m$^2$ dye, and a gelatin hardener. This layer is used to simulate a photographic layer such as a silver halide emulsion layer, filter dye layer, etc. that would typically be exposed to film developer solutions during normal film processing.

An electrically-conductive overcoat layer comprising conductive fine particles, gelatin, polymer particles, and dihydroxy dioxane hardener is applied onto the dye-containing layer by coating an aqueous formulation comprising about 4 weight % total solids and drying at 120° C. to give a dried coating weight of 1000 mg/m$^2$.

The surface resistivity of the electrically-conductive layer is measured at 20% relative humidity using a 2-point probe for the samples before and after dipping the sample in film developer solution. The sample descriptions and resistivities for the samples are tabulated in Table 2. For purposes of comparison, results are also reported for Comparative Samples A and B. Comparative Sample A has an overcoat layer that comprises only gelatin, with no conductive particles or polymer particles. Comparative sample B has an overcoat that comprises only gelatin and conductive particles, with no carboxylic acid-containing polymer particles.

Coatings of the invention provide improved conductivity at low concentration of the conductive particles compared with those comprising only gelatin and tin oxide as seen by comparing the results for Examples 1 and 2 with Comparative Sample B which contained the same amount of conductive fine particles.

TABLE 2

| Sample | Conductive Layer Composition* | Surface Resistivity, before processing (Ω/□) | Surface Resistivity, after processing (Ω/□) |
|---|---|---|---|
| Example 1 | 13.3/26.7/60 gelatin/P-1/tin oxide | $2.0 \times 10^8$ | $2.5 \times 10^8$ |
| Example 2 | 13.3/26.7/60/gelatin/P-2/tin oxide | $2.5 \times 10^8$ | $5.0 \times 10^9$ |
| Sample A | gelatin | $>1.0 \times 10^{14}$ | $>1.0 \times 10^{14}$ |
| Sample B | 40/60 gelatin/tin oxide | $1.6 \times 10^{11}$ | $4.0 \times 10^{12}$ |

*weight % ratios. Examples 1 and 2 and Comparative Sample B contain 20% conductive tin oxide particles on a volume basis.

Dry adhesion of the electrically-conductive overcoat layer to the dye-containing layer is determined by scribing small hatch marks in the coating with a razor blade, placing a piece of high tack tape over the scribed area and then quickly pulling the tape from the surface. The amount of the scribed area removed is a measure of the dry adhesion. Wet adhesion for the samples is tested by placing the test samples in deionized water at 35° C. for 1 minute. While still wet, a one millimeter wide line was scribed in the coating and a finger is rubbed vigorously across the scribe line. The percent of the rubbed area that was removed is used as a measure of wet adhesion. The adhesion results for Examples 1 and 2 of the invention are found to be excellent.

The film samples were evaluated for bleachability of the dye in film developer solution. Examples 1 and 2 of the invention were found to completely bleach the dye using development times as brief as 10 sec. These results were comparable to Comparative Sample A in which the overcoat comprised 100% gelatin. This is rather remarkable since the conductive layers of Examples 1 and 2 comprise only 13.3% gelatin and have a surface resistivity 4 to 5 orders of magnitude superior to Sample A.

While there has been shown and described what are at present considered the preferred embodiments of the invention, it will be obvious to those skilled in the art that various alterations and modifications may be made therein without departing from the scope of the claimed invention as defined by the appended claims. All such modifications are intended to be included in the present application.

We claim:

1. An imaging element comprising:

a support:

an image forming layer; and an electrically-conductive layer comprising electronically-conductive fine particles from about 5 to 50 volume percent of said electrically-conductive layer, film-forming hydrophilic colloid, and carboxylic acid-containing polymer particles having an acid number of at least 90.

2. The imaging element of claim 1 wherein the electronically-conductive conductive fine particles comprises a doped-metal oxide, a metal oxide containing oxygen deficiencies, a metal antimonate, a conductive nitride, carbide, or boride.

3. The imaging element of claim 2 wherein the electronically-conductive conductive fine particles are selected from the group consisting of conductive $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC.

4. The imaging element of claim 1 wherein the electronically-conductive conductive fine particles comprise electronically-conductive polymer particles selected from the group consisting of polythiophenes, polyanilines, and polypyrroles.

5. The imaging element of claim 1 wherein the electronically-conductive conductive fine particles have an average particle size less than about 0.3 $\mu$m.

6. The imaging element of claim 1 wherein the electronically-conductive conductive fine particles have a powder resistivity of $10^5$ Ω·cm or less.

7. The imaging element of claim 1 wherein the carboxylic acid-containing polymer particles are prepared by polymerizing one or more ethylenically unsaturated monomers containing carboxylic acid groups with other ethylenically unsaturated monomers.

8. The imaging element of claim 7 wherein the one or more ethylenically unsaturated monomers containing carboxylic acid groups are selected from the group consisting of acrylic monomers, monoalkyl itaconates, monoalkyl maleates, citraconic acid, and styrenecarboxylic acid.

9. The imaging element of claim 7 wherein the other ethylenically unsaturated monomers are selected from the group consisting of, alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinyl acetate, vinyl propionate, vinylidene chloride, vinyl chloride, vinyl aromatic compounds, dialkyl maleates, dialkyl itaconates, dialkyl methylene-malonates, isoprene, and butadiene.

10. The imaging element of claim 1 wherein the carboxylic acid-containing polymer particles further comprise crosslinking comonomers.

11. The imaging element of claim 1 wherein the carboxylic acid-containing polymer particles have a glass transition temperature ($T_g$) of at least 20° C.

12. The imaging element of claim 1 wherein the film-forming hydrophilic colloid is selected from the group consisting of alkali-treated gelatin, acid-treated gelatin, gelatin derivatives, dextran, gum arabic, zein, casein, pectin, agar-agar, albumin, and water-soluble polyvinyl compounds.

13. The imaging element of claim 1 wherein the electrically-conductive fine particles are present in an amount of from 10 to 35 volume percent.

14. The imaging element of claim 1 wherein the electrically-conductive fine particles are approximately spherical in shape.

15. The imaging element of claim 1 wherein the carboxylic acid containing polymer particles are present in an amount are from about 0.3 to about 8 parts per part by weight of the film-forming hydrophilic colloid.

16. The imaging element of claim 1 wherein the electrically-conductive layer further comprises wetting aids, lubricants, matte particles, biocides, dispersing aids, hardeners and antihalation dyes.

* * * * *